US008022321B2

(12) United States Patent
Bhat et al.

(10) Patent No.: US 8,022,321 B2
(45) Date of Patent: Sep. 20, 2011

(54) HYDRAULIC PRESSURE SWITCH WITH POROUS DISC AS SNUBBING ELEMENT

(75) Inventors: Lokesha Bhat, Bangalore (IN); Vijayshekhar Araganji, Bangalore (IN)

(73) Assignee: Honeywell International Inc., Morristown, NJ (US)

( * ) Notice: Subject to any disclaimer, the term of this patent is extended or adjusted under 35 U.S.C. 154(b) by 410 days.

(21) Appl. No.: 12/368,675

(22) Filed: Feb. 10, 2009

(65) Prior Publication Data

US 2010/0200085 A1 Aug. 12, 2010

(51) Int. Cl.
*H01H 3/24* (2006.01)

(52) U.S. Cl. ..... 200/82 R

(58) Field of Classification Search ..... 200/2 R, 200/81.9 M, 82 E, 83 D, 82 C, 83 S, 81 H, 200/277; 137/509
See application file for complete search history.

(56) References Cited

U.S. PATENT DOCUMENTS

| | | | | | |
|---|---|---|---|---|---|
| 3,564,175 | A | * | 2/1971 | Cooper | 200/82 R |
| 3,823,285 | A | * | 7/1974 | Dwyer | 200/81 H |
| 4,311,420 | A | | 1/1982 | Hendricks | 410/121 |
| 4,323,742 | A | * | 4/1982 | Priest | 200/82 C |
| 4,480,843 | A | | 11/1984 | Springer | 277/31 |
| 4,558,887 | A | | 12/1985 | Doty | 280/802 |
| 4,754,955 | A | | 7/1988 | Otsuka et al. | 267/119 |
| 5,117,961 | A | | 6/1992 | Nicholson | 198/372 |
| 6,412,560 | B1 | | 7/2002 | Bernat | 166/301 |
| 6,640,939 | B2 | | 11/2003 | Buck | 188/67 |
| 6,886,929 | B2 | | 5/2005 | Malik et al. | 347/86 |
| 6,910,375 | B2 | | 6/2005 | Butler et al. | 73/152.51 |
| 7,469,749 | B2 | | 12/2008 | Folk | 166/379 |
| 2006/0118294 | A1 | | 6/2006 | Haakenson | 166/77.52 |
| 2008/0053661 | A1 | | 3/2008 | Funk | 166/380 |

FOREIGN PATENT DOCUMENTS

| | | |
|---|---|---|
| EP | 1775743 A2 | 4/2007 |
| EP | 1775743 A3 | 4/2007 |

* cited by examiner

*Primary Examiner* — Edwin A. Leon
(74) *Attorney, Agent, or Firm* — Ingrassia Fisher & Lorenz, P.C.

(57) ABSTRACT

A hydraulic pressure switch apparatus includes a porous disc directly installed at a media entry port for dampening and filtration purposes. The porous disc includes a number of pores that are connected together and to the surface of the porous disc for allowing media to flow into a base fitting. The media exerts pressure on a piston associated with the base fitting, which in turn is capable of being absorbed by a compression spring. The compression spring transfers a required motion to a plunger associated with a micro switch in order to provide on/off switching capabilities. Electrical indications can then be transferred to a vehicle control unit utilizing a termination connector, based on particular user requirements. The porous disc can be utilized to dampen the pressure spikes and surges, which significantly prolong the life of the pressure switch apparatus in harsh applications.

20 Claims, 3 Drawing Sheets

HYDRAULIC PRESSURE SWITCH WITH POROUS DISC AS SNUBBING ELEMENT

TECHNICAL FIELD

Embodiments are generally related to hydraulic devices such as, for example, hydraulic pumps. Embodiments are also related to pressure switches utilized with hydraulic pumps. Embodiments are additionally related to snubbing elements.

BACKGROUND OF THE INVENTION

Hydraulic power systems utilize hydraulic pressure for controlling power units. Such systems generally include a pressure switch to provide an electrical signal indicating that a preset pressure has been achieved. When the pressure switch is connected to a fluid pipeline system, often there will be a rapid rise in pressure within the system, which can result in pressure surge, fluid hammer and pressure pulsation. Pressure surge is essentially the result of a wave generated when a fluid in motion is forced to stop or change direction suddenly (e.g., momentum change). Fluid hammer generates a very loud banging, knocking or hammering noise in the pipes that occurs when the flow is suddenly terminated. Fluid hammer may occur as a result of a pressure wave or a shock wave that travels faster than the speed of sound through the pipes and which is brought on by a sudden cessation in the velocity of the fluid, or a change in the fluid direction.

Fluid hammer commonly occurs when a valve is closed suddenly at the end of the pipeline system and a pressure wave propagates in the pipe. Fluid hammer can also occur due to several factors such as, for example, improperly sized piping in relation to fluid flow velocity, high fluid pressure with no pressure-reducing valve, straight runs that are too long without bends, and the lack of a dampening system in place to reduce or absorb shockwaves. Such pressure pulsations and fluid hammer present in hydraulic systems can cause serious problems regarding safety and switch reliability. Such surge phenomenon may result in fatigue and catastrophic switch failure.

Pressure snubbers are widely utilized for dampening, filtering and/or maintaining a steady flow of media. A pressure snubber is a mechanical device that limits pressure or velocity surges on measurement devices. Such pressure snubbers can be connected between the process and the measurement device allowing a relatively slow change in pressure or velocity to limit damage to the hardware. Such devices are common in industrial environments.

The majority of prior art snubbers possess a porous metal disc as a snubbing element available in three standard grades of porosity. Due to the large filter surface, such snubber has fewer tendencies to clog than an orifice type device. Additionally, the internal parts associated with the pressure switch need to be designed according to size of the snubber. Such prior art snubbers, however, require an additional adaptor, which increases the switch length and may be troublesome. Furthermore, the cost for packaging such snubbers may increase, which can lead to further enlarge the size of the final switch assembly and the complexity of the system, thereby resulting in reduced reliability.

Based on foregoing, it is believed that a need exists for an improved hydraulic pressure switch apparatus for controlling the operation of hydraulic pressure pumps. A need also exists for an improved snubbing element for dampening and filtration purposes, as described in greater detail herein.

BRIEF SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the present invention to provide for an improved hydraulic pressure switch apparatus.

It is another aspect of the present invention to provide for an improved snubbing element for use with hydraulic pressure switch apparatus.

The aforementioned aspects and other objectives and advantages can now be achieved as described herein. A hydraulic pressure switch apparatus is disclosed which includes a porous disc (e.g., stainless steel) directly installed at a media entry port for dampening and filtration purposes. The porous disc includes a number of pores that are connected together and to the surface of the porous disc for allowing media to flow into a base fitting. The media exerts pressure on a piston associated with the base fitting, which in turn is absorbed by a helical compression spring. The compression spring transfers a required motion to a plunger associated with a micro switch in order to provide on/off switching capabilities. Electrical indications can be then transferred to a vehicle control unit utilizing a termination connector based on user requirements.

The porous disc can be fabricated from metal powder particles utilizing powder metallurgy (PM) techniques. The porous disc possesses interconnected porosity and the isolated pores do not have connectivity to both surfaces to allow media flow. The thickness of the porous disc can be selected based on an operating pressure of the media through the entry port. The porous disc can be cleaned by back flushing with a solvent for maintenance purpose. The sheet material can also be made by direct powder rolling or by gravity filling of molds and calendaring before sintering. The porosity of the porous disc can be varied by selecting the proper particle size of the metal powders for use with different media such as, for example, heavy oil, light oil, water, air, and other gases. The base fitting can be designed based on user requirements. Such porous disc can be utilized to dampen the pressure spikes and surges and can significantly prolong the life of the pressure switch apparatus in harsh applications and can additionally improve the reading accuracy.

The apparatus makes electrical contact when a certain set pressure has been reached on its input, which can be utilized to provide on/off switching from a pneumatic and/or hydraulic source. The apparatus can be designed to make electrical contact either on pressure rise or on pressure fall. The porous disc filters the media entering the entry port and prevents dust, dirt, or moisture from entering the apparatus. Such pressure switch apparatus can be utilized in off-road and agriculture equipment applications, thereby providing improved accuracy and repeatability due to steady flow of media through the switch apparatus.

BRIEF DESCRIPTION OF THE DRAWINGS

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

The particular values and configurations discussed in these non-limiting examples can be varied and are cited merely to illustrate at least one embodiment and are not intended to limit the scope thereof.

Figure 1:
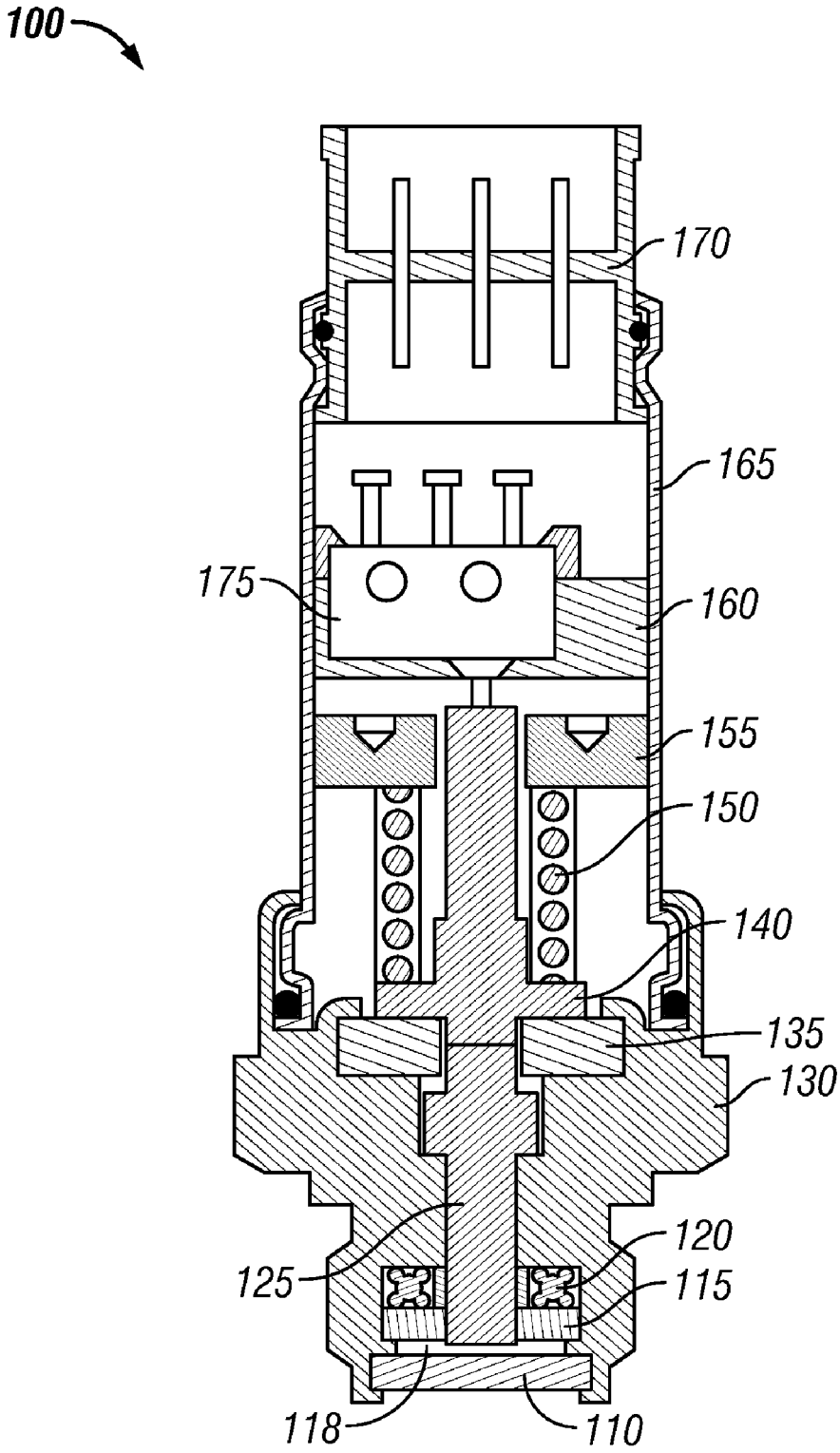
FIG. 1 illustrates a perspective view of a hydraulic pressure switch apparatus associated with a porous disc as a snubbing element, in accordance with a preferred embodiment.

FIG. 1 illustrates a perspective view of a hydraulic pressure switch apparatus 100 associated with a porous disc 110, in accordance with a preferred embodiment. The hydraulic pressure switch apparatus 100 can be utilized in wide variety of applications such as, for example, fuel, hydraulic, and engine oil pressure systems requiring discrete measure. It can be appreciated that the hydraulic pressure switch apparatus 100 can also be utilized in off-road vehicles such as, for example, earthmovers, tractors, forklifts, and backhoes.

The hydraulic pressure switch apparatus 100 generally includes a porous disc 110 directly installed at a fluid entry port 118 of the pressure switch apparatus 100 for dampening and filtration purposes. The porous disc 110 may be configured from a material such as, for example, stainless steel, depending upon design considerations. It can be appreciated that other types of materials may be utilized in place of the suggested material. The porous disc 110 includes a number of pores that are connected together and to the surfaces of the porous disc 110 for allowing media to flow into a base fitting 130. Note that as utilized herein the term "media" can refer to a fluid media such as, for example, a liquid.

The hydraulic pressure switch apparatus 100 further includes a housing 165 comprising a plunger 140, a micro switch 175 and a terminal connector 170. The housing 165 also includes an axially movable piston 125 mounted on the base fitting 130 via a sealing 120. The micro switch 175 is secured to the piston 125 which is adapted to cooperate with a baffle 135 associated with the housing 165 to activate the micro switch 175 in response to the axial movement of the piston 125. The terminal connector 170 is operatively connected to the micro switch 175. The type of micro switch utilized herein is a normally closed switch. However, it will be apparent to those of skill in the art that other type of switches can be utilized as desired without departing from the scope of the invention. The sealing 120 seals the operating mechanism of the pressure switch apparatus 100 from the media whose pressure is to be sensed.

The piston 125 can be maintained in its normal position and held within the base fitting 130 by means of a piston retainer 115. The adjustment of the spring force of the compression spring 150 by compressing or releasing the length thereof changes the necessary force to lift the piston 125 off its seat so as to move the plunger 140 and activate the micro switch 175. The change in force of the compression spring 150 changes or alters the hydraulic pressure necessary to operate the micro switch 175 located on a switch carrier 160. Adjustment of the force produced by the compression spring 150 can be accomplished by means a spring retainer 155 engaging the lower end of the compression spring 150 and is engaged with the rod of the piston 125. The compression spring 150 are held within the housing 165 by means of the spring retainer 155.

The media enters into the base fitting 130 via the porous disc 110, exerts pressure on the piston 125 which in turns gets absorbed by the helical compression spring 150. The compression spring 150 transfers the required motion to the plunger 140 of the micro switch 175 in order to provide on/off switching. When the thrust acting on the plunger 140 due to the media pressure is larger than the pushing force of the compression spring 150, the plunger 140 comes in contact with the micro switch 175 and the micro switch 175 switches to an "ON" condition. When the media pressure is less than a predetermined value, the compression spring 150 pushes the plunger 140 back downward against the thrust of the plunger 140 due to media pressure and the micro switch 175 switches to an "OFF" condition. Electrical indications can then be transferred to a control unit (not shown) utilizing the termination connector 170 based on user requirements.

Figure 2:
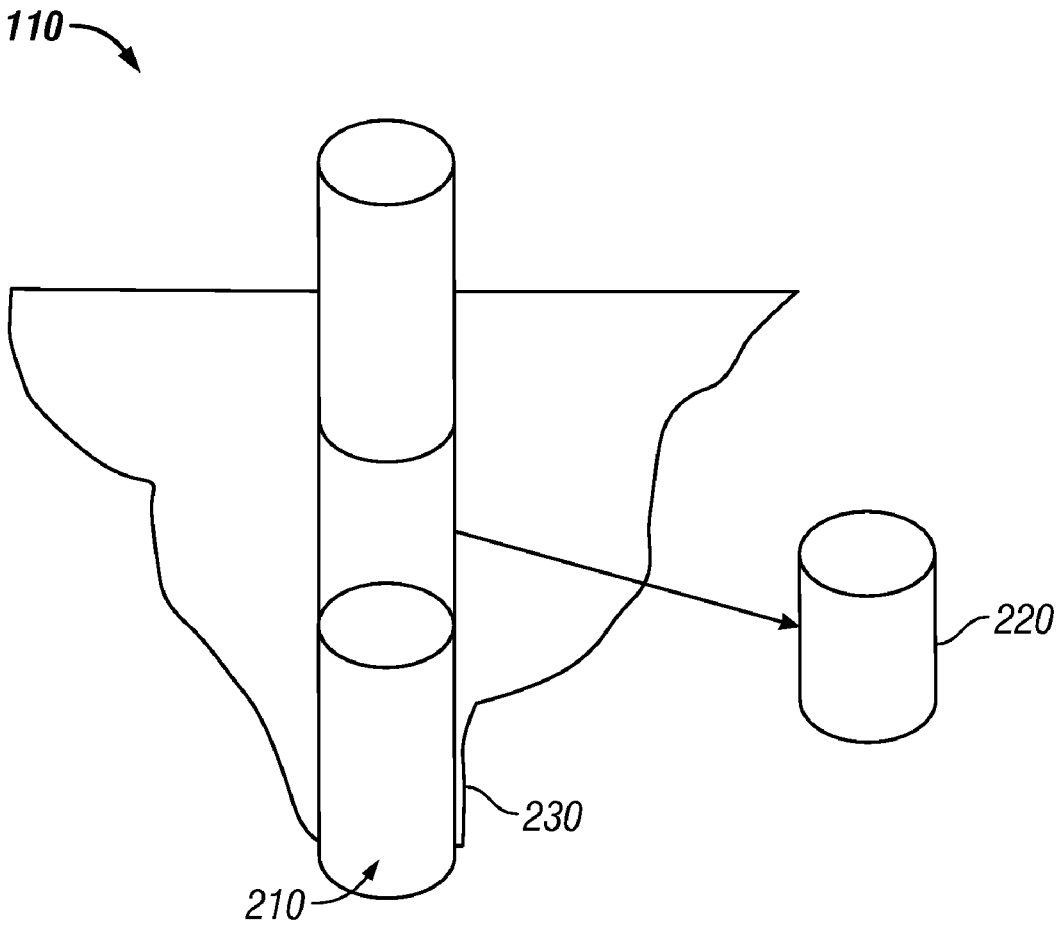
FIG. 2 illustrates a perspective view of the porous disc, in accordance with a preferred embodiment.

FIG. 2 illustrates a perspective view of the porous disc 110, in accordance with a preferred embodiment. Note that in FIGS. 1-3, identical or similar blocks are generally indicated by identical reference numerals. The porous disc 110 can be fabricated from metal powder particles 210 utilizing powder metallurgy (PM) techniques. The metal powder 210 can be pressed in a die 230 at a sufficient pressure, so that the powder particles 210 adhere at their contact points with adequate strength and the formed part can be handled adequately after ejection from the die 230. The unsintered strength of the part depends on the metal powder characteristics (composition, particle size, shape, purity, etc.) and the forming pressure. The porous metal parts 210 can be pressed at lower pressures in order to achieve specified porosity requirements. After forming, the unsintered parts can then be heated, or sintered, under controlled atmosphere at a temperature below the melting point of the metal but still sufficient to bond the particles together, thus markedly increasing the part strength.

The porous disc 110 includes high production rates, good permeability control, and excellent dimensional reproducibility. The porous disc 110 possesses interconnected porosity and the isolated pores do not have connectivity to both surfaces to allow media flow. Note that the porous disc 110 can be utilized as a snubbing element. The porous disc 110 filters the fluid entering the pressure switch apparatus 100 and prevents foreign matter from entering the switch elements such as, for example, the piston 125, the compression spring 150 and the micro switch 175. Such porous disc 110 can be utilized as filters or as orifices to filter foreign matter.

The thickness of the porous disc 110 can be selected based on the operating pressure of the media through the port entry 118. The porous disc 110 can be cleaned by back flushing with a solvent as and when required for maintenance purpose. The porous disc 110 can be utilized to dampen the pressure spikes or surges. Such a porous disc 110 can significantly prolong the life of the pressure switch apparatus 100 in harsh applications such as, for example, reciprocating pumps, compressors, hydraulic presses, or fluid power systems and can additionally improve the reading accuracy of the pressure switch apparatus 100.

The porous disc 110 is generally composed of different porosities for use with heavy oil, light oil, water, air, and other gases. Note that the sheet material described herein can also be configured by direct powder rolling or by gravity filling of molds and calendaring prior to sintering. The specified porosity can be achieved by selecting the proper particle size of the metal powders. The base fitting 130 of the switch apparatus 100 can be designed based on particular user requirements. The hydraulic pressure switch apparatus 100 is capable of making electrical contact when a certain set pressure has been attained at its input, which is utilized to provide on/off switching capabilities from a pneumatic or hydraulic source. The switch apparatus 100 can be configured to make contact either on a pressure rise or on a pressure fall. Note that the embodiments discussed herein should not be construed in any limited sense. It can be appreciated that such embodiments reveal details of the structure of a preferred form necessary for a better understanding of the invention and may be subject to change by skilled persons within the scope of the invention without departing from the concept thereof.

Figure 3:
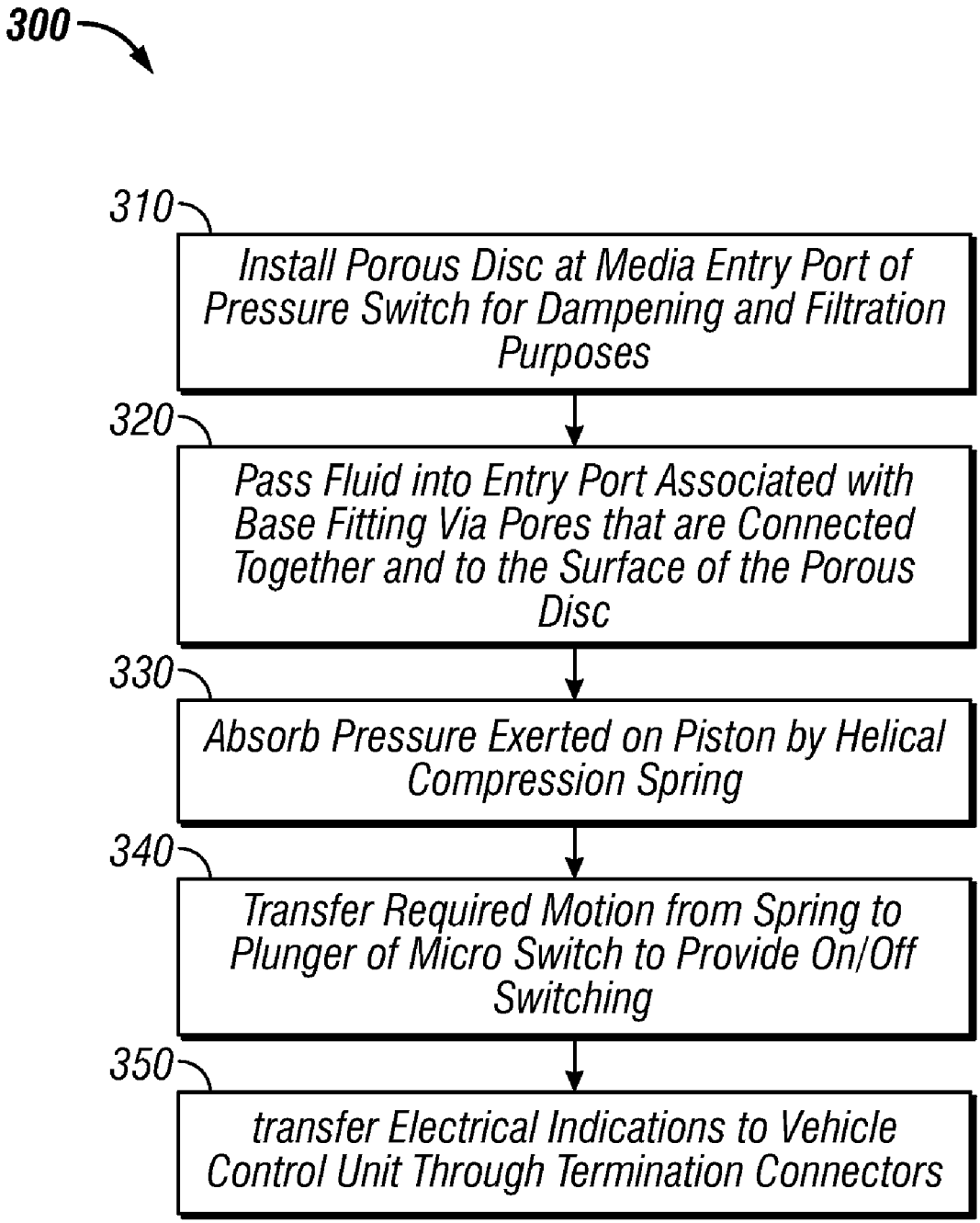
FIG. 3 illustrates a detailed flow chart of operations illustrating logical operational steps of a method for controlling the operation of hydraulic pressure pumps utilizing hydraulic pressure switch apparatus, in accordance with a preferred embodiment.

FIG. 3 illustrates a detailed flow chart of operations illustrating logical operational steps of a method 300 for controlling the operation of hydraulic pressure devices utilizing hydraulic pressure switch apparatus 100, in accordance with a preferred embodiment. The porous disc 110 can be installed at the fluid entry port 118 of the pressure switch apparatus 100 for dampening and filtration purposes, as illustrated at block 310. The fluid can be passed into the entry port 118 associated with the base fitting 130 via pores that are connected together and to the surface of the porous disc 110, as depicted at block 320. The pressure exerted on the piston 125 can be absorbed by the helical compression spring 150, as shown at block 330. Thereafter, as depicted at block 340, the required motion from the compression spring 150 can be transferred to the plunger 140 of the micro switch 175 to provide on/off switching. The electrical indications can then be transferred to the control unit through termination connectors 170, as illustrated at block 350.

The hydraulic pressure switch apparatus 100 can be utilized to switch on a warning light if engine oil pressure falls below a safe level and to switch on brake lights automatically by detecting a rise in pressure in hydraulic brake pipes. The switch apparatus 100 is of compact size with ruggedness and durability and is designed for the most hostile vibration, shock, temperature, and environmental conditions. The porous disc 110 filters the media entering the entry port 118 and prevent dust, dirt, or moisture from entering the apparatus 100. Such pressure switches 100 can also be utilized in off-road and agriculture equipment applications thereby providing improved accuracy and repeatability throughout the life of the switch due to steady flow of media through the switch apparatus 100.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A hydraulic pressure switch apparatus, said apparatus comprising;

a porous disc directly installed at an entry port associated with a base fitting for dampening and filtration, wherein said porous disc comprises a plurality of pores connected together and to a surface of said porous disc for allowing media to flow into said base fitting;

a piston located on a piston retainer, said piston operatively influenced by a hydraulic pressure exerted by said media, wherein said media is in turn absorbed by a compression spring; and a plunger positioned within a housing, said plunger positionally responsive to said media flow and in communication with a micro switch, wherein said compression spring transfers a required motion to said plunger in order to provide on/off switching capabilities based on a position of said plunger, thereby providing improved accuracy and repeatability due to a steady flow of said media.

2. The apparatus of claim 1 further comprising:

a switch carrier for mounting said micro switch; and a spring retainer for engaging a lower end of said compression spring and is engaged with a rod of said piston.

3. The apparatus of claim 1 further comprising a terminal connector in association with said micro switch in order to transfer electrical indications to a vehicle control unit based on user requirements.

4. The apparatus of claim 1 wherein:

said porous disc further comprises a plurality of metal powder particles for fabricating said porous disc utilizing a powder metallurgy technique; and said plurality of metal powder particles size are capable of being altered to provide different porosities.

5. The apparatus of claim 1 wherein said porous disc thickness is selected based on an operating pressure of said media through said entry port.

6. The apparatus of claim 1 wherein said porous disc is capable of being cleaned by a solvent utilizing a back flushing process.

7. The apparatus of claim 1 wherein said porous disc dampens pressure spikes and surges in order to significantly prolong a life of said pressure switch in harsh applications.

8. The apparatus of claim 1 wherein said porous disc comprises a stainless steel material.

9. The apparatus of claim 1 wherein said compression spring comprises a helical shape.

10. A hydraulic pressure switch apparatus, said apparatus comprising;

a porous disc directly installed at an entry port associated with a base fitting for dampening and filtration, wherein said porous disc comprises a plurality of pores connected together and to a surface of said porous disc for allowing media to flow into said base fitting;

a piston located on a piston retainer, said piston operatively influenced by a hydraulic pressure exerted by said media, wherein said media is in turn absorbed by a compression spring;

a plunger positioned within a housing, said plunger positionally responsive to said media flow and in communication with a micro switch, a switch carrier for mounting said micro switch; and a spring retainer for engaging a lower end of said compression spring and is engaged with a rod of said piston, wherein said compression spring transfers a required motion to said plunger in order to provide on/off switching capabilities based on a position of said plunger, thereby providing improved accuracy and repeatability due to a steady flow of said media and wherein said porous disc dampens pressure spikes and surges in order to significantly prolong a life of said pressure switch in harsh applications.

11. The apparatus of claim 1 further comprising:

a terminal connector in association with said micro switch in order to transfer electrical indications to a vehicle control unit based on user requirements.

12. The apparatus of claim 11 wherein:

said porous disc further comprises a plurality of metal powder particles for fabricating said porous disc utilizing a powder metallurgy technique; and said plurality of metal powder particles size are capable of being altered to provide different porosities.

13. The apparatus of claim 11 wherein said porous disc thickness is selected based on an operating pressure of said media through said entry port.

14. A method of configuring a hydraulic pressure switch apparatus, said method comprising:

installing a porous disc directly at an entry port associated with a base fitting for dampening and filtration, wherein said porous disc comprises a plurality of pores connected together and to a surface of said porous disc for allowing media to flow into said base fitting;

locating a piston on a piston retainer, said piston operatively influenced by a hydraulic pressure exerted by said media, wherein said media is in turn absorbed by a compression spring; and positioning a plunger within a housing, said plunger positionally responsive to said media flow and in communication with a micro switch, wherein said compression spring transfers a required motion to said plunger in order to provide on/off switching capabilities based on a position of said plunger, thereby providing improved accuracy and repeatability due to a steady flow of said media.

15. The method of claim 14 further comprising:

providing a switch carrier for mounting said micro switch; and utilizing a spring retainer to engage a lower end of said compression spring and interact with a rod of said piston.

16. The method of claim 14 further comprising a terminal connector in association with said micro switch in order to transfer electrical indications to a vehicle control unit based on user requirements.

17. The method of claim 14 further comprising:

modifying said porous disc to further include a plurality of metal powder particles for fabricating said porous disc utilizing a powder metallurgy technique; and configuring said plurality of metal powder particles, such that a size of said plurality of metal powder particles is capable of being altered to provide different porosities.

18. The method of claim 14 further comprising selecting a thickness of said porous disc thickness based on an operating pressure of said media through said entry port.

19. The method of claim 14 further comprising configuring said porous disc to dampen pressure spikes and surges in order to significantly prolong a life of said pressure switch in harsh applications.

20. The method of claim 14 further comprising:

configuring said porous disc from a stainless steel material; and providing said compression spring with a helical shape.

* * * * *